US005419666A

United States Patent [19]

Best

[11] Patent Number: 5,419,666

[45] Date of Patent: May 30, 1995

[54] PROTECTIVE WATERPROOF COVER ASSEMBLY FOR COVERING A FASTENER

[76] Inventor: Don A. Best, P.O. Box 14574, Oklahoma City, Okla. 73120

[21] Appl. No.: 127,323

[22] Filed: Sep. 27, 1993

[51] Int. Cl.[6] ..... F16B 43/00

[52] U.S. Cl. ..... 411/373; 411/377; 411/542

[58] Field of Search ..... 411/371, 372, 377, 363, 411/542, 915, 369; 52/410

[56] References Cited

U.S. PATENT DOCUMENTS

| | | | |
|---|---|---|---|
| 1,867,736 | 7/1932 | Finkeldey | 411/373 |
| 2,099,990 | 11/1937 | Rosenberg | 411/377 |
| 2,710,113 | 6/1955 | Pritchard | 411/915 X |
| 2,718,691 | 9/1955 | Sussenbach | 411/915 X |
| 4,467,581 | 8/1984 | Francovitch | 411/542 X |
| 4,747,241 | 5/1988 | Whitman | 52/173 R |
| 4,757,662 | 7/1988 | Gasser | 411/372 X |
| 4,788,807 | 12/1988 | Whitman | 411/369 X |
| 4,836,380 | 5/1989 | Henry | 411/377 |
| 4,923,348 | 5/1990 | Carlozzo et al. | 411/377 |
| 4,944,644 | 7/1990 | Bell | 411/372 |
| 5,018,329 | 5/1991 | Hasan et al. | 52/410 |
| 5,204,148 | 4/1993 | Alexander et al. | 52/410 |

FOREIGN PATENT DOCUMENTS

| | | | |
|---|---|---|---|
| 2845492 | 4/1980 | Germany | 411/373 |

*Primary Examiner*—Rodney M. Lindsey
*Attorney, Agent, or Firm*—John R. Flanagan

[57] ABSTRACT

A protective waterproof cover assembly includes a a truncated-conical dome-shaped rigid cover adapted to overlie a fastener installed through a surface of a support structure and provide sufficient clearance between the cover and the surface to permit loosening of the fastener and movement of a head of the fastener away from the surface, a flexible waterproof circular pad having a diameter which is greater than that of the cover adapting the pad to overlie the cover such that an outer annular portion of the pad extends beyond a perimeter of the cover and overlies an annular portion of the surface of the support structure which surrounds the cover, and a layer of adhesive applied to a bottom face of the pad for adhering the pad to the cover and to the annular portion of the support structure surface. A peelable backing sheet is applied to the adhesive layer.

18 Claims, 1 Drawing Sheet

20
2
22
24b
P
R
24
S 20
24b
24
S
P
24a
26
R 22
28
H
20
24C
24b
24
30
36
24a
3
P
A
R
22
F
34
38
S
24
26

28b
28
32
22
30b
28a
30
36
34
30a 36
22
28
30
32
28b
30b 28
36
22
32
30
30a
28a 20
38
26
24a
24
24b

PROTECTIVE WATERPROOF COVER ASSEMBLY FOR COVERING A FASTENER

BACKGROUND OF THE INVENTION

1. Field of the Invention

The present invention generally relates to roofing construction devices and, more particularly, is concerned with a protective waterproof cover assembly for covering a fastener.

2. Description of the Prior Art

A variety of devices have been developed to improve roofing construction methods. Such devices generally pertain to the installation of roofing panels over a basic underlying roofing structure. Some devices focus particularly on the reinforcement of the panels to one another. Other devices provide protective features for maintaining fasteners within their installed panel positions.

Representative examples of these types of devices are disclosed in U.S. Pat. Nos. to Rosenberg (2,099,990), Whitman (4,747,241), Carlozzo et al (4,923,348) and Hasan et al (5,018,329). The Rosenberg and Carlozzo et al devices focus, respectively, on reinforcing a fastener head, and on providing a protective cap therefor so as to prevent injury to the fastener and to ensure against moisture leakage thereabout for preventing water damage to a building. The Whitman and Hasan et al devices pertain more generally to reinforcing installed roofing panels. The Whitman device utilizes bonding plates for such reinforcement. The Hasan et al device provides a screw with a composite roofing washer for heat-sealing the screw to a roofing panel or heat-sealing overlapping panels.

None of these devices, however, adequately address the problem of fastener loosening over time due to roofing panel expansion and contraction caused by differing weather conditions. Such expected fastener loosening requires that fastener covers or reinforcers make allowance in some manner for such occurrence so as to prevent breakage of the cover or reinforcer upon such fastener loosening. Additionally, the Rosenberg, Whitman and Hasan et al devices are all rather complex in construction and thus costly to manufacture. The Whitman and Hasan et al devices, in particular, are fairly complicated to apply, making utilization thereof rather difficult and cumbersome, even for a person of ordinary skill in such matters.

Consequently, a need exists for a protective type of fastener cover which is simple in design and construction for inexpensive manufacture and easy to use. The fastener cover should provide an area of clearance therein to allow for the expected loosening of an installed fastener over time, without permitting the fastener to back out completely from its installed position. A roofing panel would thereby be maintained in its proper position on an underlying roofing structure, allowing no gaps to develop between such panels due to misalignment thereof from loss of the installed fasteners.

SUMMARY OF THE INVENTION

The present invention provides a protective waterproof cover assembly for covering a fastener being designed to satisfy the aforementioned needs by avoiding the drawbacks of the prior art without introducing other drawbacks. Instead, the protective waterproof cover assembly of the present invention provides expanded capabilities not available in the prior art devices.

One capability is the simplicity in design and construction of the protective waterproof cover assembly for inexpensive manufacture and easy use. A second capability is the clearance provided within the protective cover to allow for some expected fastener loosening over time due to roofing panel expansion and contraction because of differing weather conditions. A third capability is the waterproof nature of the material comprising the protective cover assembly for preventing incremental water seepage through the fastener installation area.

Accordingly, the present invention is directed to a protective waterproof cover assembly for covering a fastener which comprises: (a) a dome-shaped rigid cover adapted to overlie a fastener installed through a surface of a support structure and provide sufficient clearance between said cover and the surface to permit loosening of the fastener and movement of a head of the fastener away from the surface; (b) a flexible pad having a diameter which is greater than a diameter of the rigid cover adapting the pad to overlie the cover such that an outer annular portion of the pad extends beyond a perimeter of the cover and overlies the surface through which the fastener is installed; and (c) means for attaching the outer annular portion of the pad to the surface.

The dome-shaped rigid cover has a top portion and an annular side portion surrounding and being attached, preferably integrally formed, with the perimeter of the top portion. The top portion has opposed inner and outer planar surfaces. The annular side portion has a truncated conical shape with inner and outer surfaces. The annular side portion and top portion of the cover together define an internal cavity in the cover with the top portion defining the top of the internal cavity being disposed at a sufficient height above the surface for permitting elevating of the head of the fastener within the internal cavity upon the fastener loosening up from its installation through the surface. The height of the top portion of the cover above the surface is of less height than the total length of the fastener, thereby preventing the fastener from completely backing out of and away from the surface. The dome-shaped cover is made of a substantially rigid material.

The flexible pad, being of flat disk-like shape and fabricated of a waterproof material, has opposite planar lower and upper faces. The attaching means is an adhesive layer applied to one of the opposite faces of the pad and encompassing at least the outer annular portion of the pad. Preferably, the adhesive layer is applied to substantially the entire one face of the pad so as to adapt the pad to adhere to the cover and to an annular portion of the surface surrounding the fastener and the perimeter of the cover. The assembly also includes a backing sheet covering the adhesive layer and being peelable therefrom at the time of application of the pad.

A plurality of roofing panels may be fastened to an underlying roofing structure by a plurality of fasteners such as screws being installed therethrough. The roofing panels tend to expand and contract due to hot or freezing weather conditions. Such expansion and contraction of the panels tends to cause loosening of the screws over time from their installed positions therethrough. Such loosening of the screws may cause misalignment of the roofing panels, thereby permitting moisture seepage therebetween into a building, causing damage to the building and its contents.

Application of the protective waterproof cover assembly, being consecutively formed by the rigid cover and the flexible pad, so as to overlie the head of the installed screw provides clearance for such expected loosening of the screw while preventing complete loss of the screw from its installed position. The fastened roofing panels are thereby maintained substantially in their aligned positions with one another so as to prevent moisture seepage therebetween into the building.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2, 3, 4, 5, 6, 7, 8:
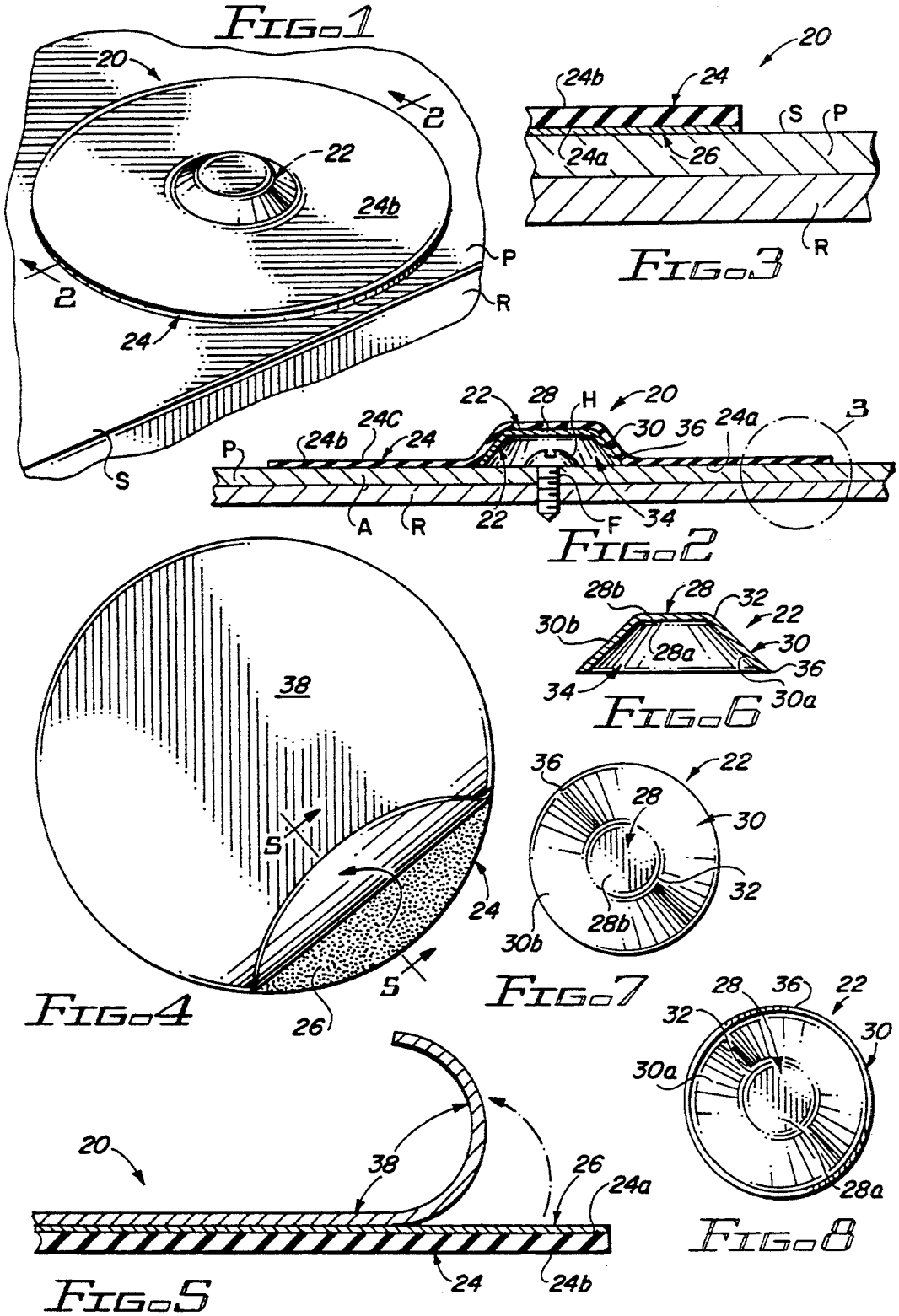
FIG. 1 is a top perspective view of a protective waterproof cover assembly of the present invention shown adhered to a roofing panel.
FIG. 2 is an enlarged cross-sectional view taken along line 2—2 of FIG. 1 showing the assembly covering a fastener, such as a screw, installed through a roofing panel.
FIG. 3 is an enlarged cross-sectional view of the portion of the assembly enclosed within the circle 3 of FIG. 2, showing an adhesive layer on a pad of the assembly adhering to the roofing panel surface.
FIG. 4 is a bottom plan view of the pad of the assembly, showing a backing sheet slightly peeled away from the adhesive layer coated thereon.
FIG. 5 is an enlarged cross-sectional view taken along line 5—5 of FIG. 4, showing the backing sheet being peeled away from the adhesive layer on the pad.
FIG. 6 is a diametrical cross-sectional view of the dome-shaped cover of the assembly.
FIG. 7 is a top plan view of the dome-shaped cover of the assembly.
FIG. 8 is a bottom plan view of the dome-shaped cover of the assembly.

Referring to the drawings and particularly to FIGS. 1 and 2, there is illustrated a protective waterproof cover assembly of the present invention, generally designated 20. The protective waterproof cover assembly 20 is shown covering a fastener F, such as a screw with a threaded stem, installed through a surface S of a structure, such as a roofing panel P superimposed on an underlying roofing structure R, with a head H of the screw F seated upon the surface S of the panel P.

Basically, the protective waterproof cover assembly 20 includes a rigid cover 22 having a dome-shaped configuration and a flexible pad 24 being fabricated of a waterproof material. The flexible pad 24 is adapted to overlie the cover 22 and, in turn, both the cover 22 and flexible pad 24 are adapted to overlie the head H of the screw F after the screw has been installed through the roofing panel P and the underlying roofing structure R. The protective waterproof cover assembly 20 also includes an adhesive layer 26 applied on a lower one of a pair of planar opposite upper and lower faces **24*a*, 24*b* of the pad 24**.

Referring particularly to FIGS. 2 and 6–8, the rigid dome-shaped cover 22 has a substantially flat top portion 28 and an annular side portion 30 surrounding and attached to a peripheral edge 32 of the top portion 28 and extending angularly outwardly and downwardly away from the top portion 28. The flat top portion 28 has a pair of opposite inner and outer surfaces **28*a*, 28*b*. The annular side portion 30 preferably has a truncated conical shape and a pair of opposite inner and outer surfaces 30*a*, 30*b*. Preferably, the cover 22 is fabricated from a resilient and durable material, such as a hot galvanized metal, and the top portion 28 and annular side portion 30 of the cover 22 are integrally connected together. Together, the annular side portion 30 and flat top portion 28 define an internal cavity 34 therein being open at the bottom of the cover 22 and closed at the top thereof Also, as seen in FIG. 2, the annular side portion 30 of the cover 22 extends around the head H of the screw F in an outwardly spaced relationship therefrom and has a lower peripheral edge 36 which engages the surface S of the panel P and supports the cover 22** thereupon.

The flat top portion 28 of the cover 22 defines a closed top of the internal cavity 34 being disposed at a sufficient height above the surface S for permitting elevating of the head H of the screw F within the cavity 34 should the fastener F loosen up from its installed position upon and through the surface S. Further, the height of the flat top portion 28 of the cover 22 above the surface S is less than the total length of the screw F, thereby preventing the screw F from completely loosening up and backing out of and away from the surface S. A preferred height of the dome-shaped cover 22 is about $\frac{1}{3}$ inch such that the internal cavity 34 is of such height as to provide sufficient clearance to receive the head H of the screw F in the cavity 34 and permit some loosening and backing off of the screw F but to prevent complete loosening thereof, as described above. Essentially, the screw F thereby remains fastened in its installed position through the roofing panel P.

Referring particularly to FIGS. 1 and 4, the flexible waterproof pad 24 has a flat, disk-shaped, circular configuration and a pair of opposite lower and upper faces **24*a*, 24*b*. The pad 24 has a diameter which is substantially greater than a diameter of the annular side portion 30 of the rigid cover 22. The pad 24 is thereby adapted to overlie the cover 22 and have an outer annular portion 24*c* which extends radially outwardly beyond a lower peripheral edge 36 of the annular side portion 30 of the cover 22 and overlie an annular portion A of the surface S surrounding the cover 22 and screw F. Preferably, the flexible pad 24** is made of a waterproof, durable material such as a modified butyl rubber and includes a reinforcing fabric such as polyester for added strength and resilience.

Referring to FIGS. 3–5, the adhesive layer 26 is applied to and coats the lower face **24*a* of the flexible pad 24. The adhesive layer 26 coats at least the annular portion of the lower face 24*a* of the pad 24 which overlies the annular portion A of the surface S and preferably coats the entire lower face 24*a*. The cover assembly 20 further includes a backing sheet 38 of a suitable material, such as paper, with a release agent on the surface contacting the adhesive layer 26. The backing sheet 38 covers the adhesive layer 26 and is peelable therefrom at the time of application of the pad 24 to assemble it over the cover 22**.

Referring particularly to FIGS. 1–3, the protective waterproof cover assembly 20 is utilized in the following manner. One or more of the roofing panels P are positioned for attachment to the underlying roofing structure R. A plurality of the screws F are each then installed through both the roofing panel P and the underlying roofing structure R, as seen in FIG. 2. The roofing panel P tends to expand and contract due to differing hot and freezing weather conditions. Such a panel change over time tends to cause loosening of the screw F from its initially installed position, such that the screw may back away completely therefrom, leaving the panel P partially or completely unsecured, without fasteners. The roofing panels F may thereby become misaligned with one another, creating gaps therebetween through which moisture may seep into a building, causing damage thereto. It is therefore crucial to maintain the screws F essentially in their installed positions so as to prevent such misalignment of the roofing panels P and consequent damage to a building from moisture seepage. Therefore, one set of the protective waterproof cover assembly 20 is applied over the head H of each installed screw F. The rigid cover 22 of the assembly 20 is first positioned so as to overlie an installed screw F with its lower peripheral edge 36 disposed in engagement with and supporting the cover 22 upon the surface S of the panel P. The internal cavity 34 of the cover 22 is closed at the lower peripheral edge 36 thereof by such engagement of the lower peripheral edge 36 with the surface S of the panel P. The internal cavity 34 defined within the rigid cover 22 provides sufficient clearance therein such that the screw F may loosen somewhat from its initial installed position without completely working itself away from the surface S. The backing sheet 38 is then peeled away from the adhesive layer 26 coated on the lower face 24*a* of the pad 24, as seen in FIGS. 4 and 5. The flexible pad 24 is then centrally positioned over the rigid cover 22 and pressed downwardly by finger pressure. The adhesive layer 26 on the lower face 24*a* of the pad 24 thereby makes contact with and adheres to the outer surface 28*b* of the top portion 28 of the cover 22 as well as with the outer surface 30*b* of the annular side portion 30 thereof, as seen in FIGS. 1 and 2. By exerting downward finger pressure uniformly over the entire upper face 24*b* of the pad 24, the adhesive layers 26 coating the lower face 24*a* thereof further makes contact with and adheres to the annular portion A of the roofing surface S adjacent to the rigid cover 22, as seen in FIGS. 1 and 2, thereby retaining the cover 22 over the head H of the fastener F and retaining the lower peripheral edge 36 of the cover 22 engaged with the surface S of the panel P and completely sealing the installed screw F and adjacent roofing surface S from exposure to outside moisture or other weather conditions.

No additional sealants need be added to the protective waterproof assembly 20 upon securement thereof over an installed fastener F. The waterproof and durable nature of the material used for the flexible pad 24 as well as the adhesion features thereof ensure the maintenance of the protective assembly 20 over the fastener F. Additionally, the clearance feature provided by the dome-shaped cover 22 makes allowance for expected loosening of installed screws over time such that roofing panels P remain in proper alignment regardless of prevailing weather conitions.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. In combination with a fastener installed through a surface of a support structure and having a head disposed thereabove, a protective waterproof cover assembly sealed to the surface of the support structure and thereby sealably covering said head of said fastener, said assembly comprising:

(a) a cover having a top portion and an annular side portion surrounding and attached to a peripheral edge of said top portion and extending downwardly and outwardly away from said top portion, said top portion of said cover overlying said head of said fastener installed through the surface of the support structure, said annular side portion of said cover extending around said head of said fastener in an outwardly spaced relationship therefrom and having a lower peripheral edge engaging the surface of the support structure and supporting said cover thereupon such that said top portion and said annular side portion of said cover together define an internal cavity in said cover being closed at said lower peripheral edge thereof by said engagement of said lower peripheral edge with the surface of the support structure, said top portion of said cover being disposed at a sufficient height above the fastener for providing sufficient clearance between said cover and said fastener to permit loosening of said fastener and movement of said head of said fastener away from the surface and toward said top portion of said cover and thus elevating of said head of said fastener within said internal cavity upon said fastener loosening up from its installation through the surface;

(b) a flexible pad of waterproof material having a diameter which is greater than a diameter of said cover adapting said pad to overlie said cover such that an outer annular portion of said pad extends beyond said lower peripheral edge of said annular side portion of said cover and overlies an annular portion of the surface through which said fastener is installed; and (c) means for sealably attaching at least said outer annular portion of said pad to the annular portion of the surface such that said cover is retained over said head of said fastener and said lower peripheral edge of said cover is retained in engagement with the surface of the support structure.

2. The assembly of claim 1 wherein said flexible pad is fabricated of a waterproof material.

3. The assembly of claim 1 wherein said top portion and said annular side portion of said cover are integrally connected together.

4. The assembly of claim 1 wherein said annular side portion of said cover has a truncated conical shape.

5. The assembly of claim 1 wherein said flexible pad has a disk-shaped configuration.

6. The assembly of claim 1 wherein the height of said top portion of said cover above the surface is of less height than a total length of the fastener, thereby preventing the fastener from completely backing out of and away from the surface.

7. The assembly of claim 1 wherein said flexible pad includes a reinforcing fabric for adding resiliency to said waterproof material of said pad.

8. The assembly of claim 1 wherein said attaching means is an adhesive layer applied to one of a pair of opposite faces of said pad and encompassing at least an outer annular portion of said one face of said pad.

9. The assembly of claim 8 wherein said adhesive layer is applied entirely to said one face of said pad so as to adapt said pad to adhere to said cover and to the annular portion of the surface surrounding the fastener and said perimeter of said cover.

10. The assembly of claim 8 further comprising:

a backing sheet covering said adhesive layer and being peelable therefrom.

11. In combination with a fastener installed through a surface of a support structure and having a head disposed thereabove, a protective waterproof cover assembly sealed to the surface of the support structure and thereby sealably covering said head of said fastener, said assembly comprising:

(a) a cover having a rigid dome-shaped configuration and including a flat top portion and an annular side portion surrounding and attached to a peripheral edge of said flat top portion and extending angularly outwardly and downwardly away therefrom, said flat top portion of said cover overlying said head of said fastener installed through the surface of the support structure, said annular side portion of said cover extending around said head of said fastener in an outwardly spaced relationship therefrom and having a lower peripheral edge engaging the surface of the support structure and supporting said cover thereupon such that said flat top portion and annular side portion of said cover together define an internal cavity in said cover being closed at said lower peripheral edge thereof by said engagement of said lower peripheral edge of said cover with the surface of the support structure, said flat top portion of said cover being disposed at a sufficient height above said fastener for providing sufficient clearance between said cover and said fastener to permit loosening of the fastener and movement of said head of said fastener away from the surface and toward said flat top portion of said cover and thus elevating of said head of said fastener within said internal cavity upon said fastener loosening up from its installation through the surface;

(b) a flexible pad having a diameter which is greater than a diameter of said cover adapting said pad to overlie said cover such that an outer annular portion of said pad extends beyond said lower peripheral edge of said annular side portion of said cover and overlies an annular portion of the surface through which said fastener is installed, said flexible pad being fabricated of a waterproof material and having a pair of opposite upper and lower faces; and (c) means on said lower face of said pad for sealably attaching at least said outer annular portion of said pad to the annular portion of the surface such that said cover is retained over said head of said fastener and said lower peripheral edge of said cover is retained in engagement with the surface of the support structure.

12. The assembly of claim 11 wherein said fiat top portion and said annular side portion of said cover are integrally connected together.

13. The assembly of claim 11 wherein said annular side portion of said cover has a truncated conical shape.

14. The assembly of claim 11 wherein the height of said top portion of said cover above the surface is of less height than a total length of the fastener, thereby preventing the fastener from completely backing out of and away from the surface.

15. The assembly of claim 11 wherein said flexible pad has a disk-shaped configuration.

16. The assembly of claim 11 wherein said attaching means is an adhesive layer applied to said lower face of said pad and encompassing at least an outer annular portion of said lower face of said pad.

17. The assembly of claim 16 wherein said adhesive layer is applied entirely to said lower face of said pad so as to adapt said pad to adhere to said cover and to the annular portion of the surface surrounding the fastener and said perimeter of said cover.

18. The assembly of claim 16 further comprising:

a backing sheet covering said adhesive layer and being peelable therefrom.

* * * * *